US007104268B2

(12) United States Patent
Wu et al.

(10) Patent No.: US 7,104,268 B2
(45) Date of Patent: Sep. 12, 2006

(54) MEGASONIC CLEANING SYSTEM WITH BUFFERED CAVITATION METHOD

(75) Inventors: Yi Wu, Irvine, CA (US); Cole S. Franklin, San Clemente, CA (US); Brian Fraser, Los Angeles, CA (US); Thomas Nicolosi, Mission Viejo, CA (US)

(73) Assignee: Akrion Technologies, Inc., Wilmington, DE (US)

( * ) Notice: Subject to any disclaimer, the term of this patent is extended or adjusted under 35 U.S.C. 154(b) by 520 days.

(21) Appl. No.: 10/341,425

(22) Filed: Jan. 10, 2003

(65) Prior Publication Data

US 2004/0134514 A1 Jul. 15, 2004

(51) Int. Cl.
*B08B 6/00* (2006.01)

(52) U.S. Cl. ..... 134/1.3; 134/1; 134/31; 134/34; 134/42; 438/906; 310/311; 310/316.01; 310/317

(58) Field of Classification Search ..... 310/311, 310/317, 316.01; 134/1, 1.3, 34, 184, 31, 134/42; 438/906
See application file for complete search history.

(56) References Cited

U.S. PATENT DOCUMENTS

| | | | | |
|---|---|---|---|---|
| 3,085,185 A | * | 4/1963 | Jacke et al. | 318/116 |
| 4,071,179 A | | 1/1978 | Antonevich | 228/1 A |
| 4,409,999 A | | 10/1983 | Pedziwaitr | 134/95 |
| 4,728,368 A | | 3/1988 | Pedziwaitr | 134/1 |
| 4,736,130 A | | 4/1988 | Puskas | 310/316 |
| 4,819,164 A | | 4/1989 | Branson | 364/200 |
| 4,964,091 A | | 10/1990 | Cook | 367/165 |
| 5,076,584 A | | 12/1991 | Openiano | 273/148 B |
| 5,137,580 A | | 8/1992 | Honda | 134/1 |
| 5,447,171 A | | 9/1995 | Shibano | 134/102.2 |
| 5,462,604 A | | 10/1995 | Shibano et al. | 134/1 |
| 5,523,058 A | * | 6/1996 | Umemura et al. | 422/128 |
| 5,534,076 A | | 7/1996 | Bran | 134/1 |
| 5,578,888 A | * | 11/1996 | Safabakhsh | 310/328 |
| 5,617,887 A | | 4/1997 | Shibano | 134/184 |
| 5,656,095 A | | 8/1997 | Honda et al. | 134/1 |
| 5,748,566 A | | 5/1998 | Goodson | 367/158 |
| 5,865,199 A | | 2/1999 | Pedziwaitr et al. | 134/184 |
| 5,895,997 A | | 4/1999 | Puskas et al. | 310/316 |
| 5,906,687 A | | 5/1999 | Masui et al. | 134/1.3 |
| 5,909,741 A | | 6/1999 | Ferrel | 134/1 |
| 5,998,908 A | | 12/1999 | Goodson | 310/325 |
| 6,019,852 A | | 2/2000 | Pedziwaitr et al. | 134/1 |

(Continued)

FOREIGN PATENT DOCUMENTS

WO WO 9603223 A1 * 2/1996

OTHER PUBLICATIONS

Paskas, W. & Piazza, T., *Designer Waveforms: Ultrasonic Technologies to Improve Cleaning and Eliminate Damage*, Precision Cleaning, Sep. 2000, pp. 22-31.

(Continued)

*Primary Examiner*—M. Kornakov
(74) *Attorney, Agent, or Firm*—Wolf, Block, Schorr & Solis-Cohen, LLP; Brian L. Belles

(57) ABSTRACT

A wafer cleaning method and system including a combined high frequency signal, a low frequency signal, and in one embodiment a biased voltage signal, allows cleaning particles and impurities off of fine-structured wafers, through application of an acoustic field to the wafer through a cleaning liquid which fosters micro-bubble formation for effective cleaning while buffering micro-bubble growth which would otherwise damage the wafer.

12 Claims, 5 Drawing Sheets

U.S. PATENT DOCUMENTS

| | | | | |
|---|---|---|---|---|
| 6,057,908 | A | 5/2000 | Ota | 355/55 |
| 6,189,547 | B1 | 2/2001 | Miyyamoto et al. | 134/57 R |
| 6,276,370 | B1 * | 8/2001 | Fisch et al. | 134/1.3 |

OTHER PUBLICATIONS

Gouk, R., *Experimental Study of Acoustic Pressure and Cavitation Fields in a Megasonic Tank*, Master's Thesis, University of Minnesota, Jul. 1996.

Neppiras, E. A, & Coakley, W. T., *Acoustic Cavitation in a Focused Field in Water at 1 MHz*, Journal of Sound and Vibration (1976), vol. 45, No. 3, pp. 341-373 (1976).

Madanshetty, S. et al., *Acoustic microcavitation: its active and passive acoustic detection*, Journal of the Acoustic Society of America, vol. 90, No. 3, pp. 1515-1526 (Sep. 1991).

Putterman, S., *Sonoluminescence: Sound into Light*, Scientific American, Feb. 1995, pp. 46-51.

Kanetaka, H. et al., *Influence of the Dissolved Gas in Cleaning Solution on Silicon Wafer Cleaning Efficiency*, Solid State Phenomena vols. 65-66, pp. 43-48 (1999).

Hilgenfeldt, S., et al., *Water temperature dependence of single bubble sonoluminescence*, Phys. Rev. Lett. 80, pp. 1332-1335 (1998).

Busnaina, A. & Kashkoush, I., *The Effect of Time, Temperature and Particle Size on Submicron Particle Removal Using Ultrasonic Cleaning*, Chemical Engineering Communications, 1993, vol. 125, pp. 47-61.

Zhang, D., *Fundamental Study of Megasonic Cleaning*, Doctoral Thesis, University of Minnesota, Jun. 1993.

* cited by examiner

MEGASONIC CLEANING SYSTEM WITH BUFFERED CAVITATION METHOD

BACKGROUND OF THE INVENTION

1. Field of the Invention

This invention relates to methods and systems for cleansing semiconductor wafers and other items requiring extremely high levels of cleanliness, while minimizing damage to the wafer or object being cleaned.

2. Description of the Related Art

Systems employing megasonic or ultrasonic cleaning processes have been widely used to remove particles and defects from objects such as silicon wafers used in the semiconductor industry. The wafers are sometimes cleaned, for example, in a liquid or fluid into which megasonic energy is propagated. These megasonic cleaning systems safely and effectively remove particles from objects, where a system typically includes a signal generator, a piezoelectric transducer, and a transmitter, among other components. The transducer is electrically excited by a signal that causes it to vibrate, and the transmitter transmits the resulting vibration into the cleaning liquid in a processing tank. For an object such as a silicon wafer, the agitation of the cleaning liquid produced by the megasonic energy loosens particles and contaminants on the semiconductor wafers. Such contaminants are thus vibrated away from the surfaces of the wafer.

While the size of silicon chips has increased, the width of a circuit line (the line width) on the chips has become smaller in order to fit more devices on each chip. As a result, the critical particles too small to be effectively removed by older cleaning systems should be removed, but without wafer structure damage: these small particles and defects, on the order of about 0.16 μm or below, should be removed to ensure proper circuit function. At the same time, the removal process should not damage the fine structure of the chip.

A megasonic cleaning system typically creates a megasonic field, where the field is applied to an object in a cleaning fluid, such as, for example, a detergent liquid or hydrofluoric acid. The megasonic field causes bubbles to appear, pulsatingly vibrate, and collapse in the cleaning fluid. This process of bubble formation and collapse in a megasonically agitated liquid—cavitation—is the main contribution factor for effective particle removal from objects.

Cavitation is a physical phenomenon. In a liquid or other fluid energized by an acoustic field, bubbles are generated when the amplitude of negative pressure of sound waves exceeds the threshold pressure for cavitation of the liquid. Generally, the cavitation threshold is determined by the time interval of negative pressure cycles in the sound waves as they move through the liquid, along with other factors including but not limited to liquid gas content, temperature, viscosity, and liquid surface tension. Bubbles can contain vacuum, gas, liquid vapor, or a mixture thereof. The bubbles continue to pulsate and grow, and fresh gas or water vapor will continue to diffuse into the bubbles, in a process called microstreaming. Generally, negative acoustic pressure causes the bubbles to grow, and positive acoustic pressure limits the size of bubbles or provokes collapse.

Once the surface tension of a bubble is insufficient to withstand the positive pressure cycles caused by the sound waves of the applied acoustic field, the bubble collapses. The bubble collapse typically generates concentrated pressure, high temperatures, and shock waves in the cleaning liquid. The speed of bubble collapse is typically more than 300 m/sec., and high temperatures in the liquid often occur within the order of a nanosecond. As with the cavitation threshold, factors including gas content, temperature, viscosity, and liquid surface tension between the liquid and the bubbles typically influence the bubble size and density in the cleaning liquid or other fluid.

Cavitation and microstreaming, while important to wafer cleaning, also substantially increase the risk of damage to the fine structures on objects such as silicon wafers, including, for example, fine patterns on the wafers or thin films covering the wafers. Large bubbles often interact with the object to be cleaned resulting in substantial damage rather, than cleaning, where the damage often results from the violent pressure and shock waves from cavitation bubble collapse near the object. From a cleaning efficiency point of view, although a high density micro bubble field is needed to clean an object in a megasonic cleaning processes, that field must not be so strong as to damage fine structures and films on the wafer or object to be cleaned.

One solution to this problem is an increase in megasonic frequency applied to the cleaning liquid. The increase in frequency results in a shorter sonic wavelength, smaller negative sound pressure cycles in sound waves, and thus formation of smaller, less damaging bubbles. Another solution is a decrease in megasonic power. However, both of these solutions have a fundamental flaw when applied alone: although the average cavitation intensity (and hence wafer damage) is decreased in the local liquid region close to the wafer, the local bubble density decreases as well. The decrease in local bubble density hinders the cleaning effectiveness of the megasonic process. Thus, while bubble size is advantageously buffered, bubble quantity is buffered as a side effect, resulting in less effective cleaning.

While many investigations have been made into the control of various megasonic process parameters, such as, for example, changes in train time, degas time, burst time, and quiet time of sound waves, it is the use of continuous sound waves that generates the highest cleaning efficiency. So while changes in these various wave times typically modify cleaning process parameters, they cannot optimize the cavitation cleaning process: only continuous sound waves have the lowest cavitation threshold for bubble production at a selected frequency. For example, increasing quiet time or degas time for a megasonic field can decrease average cavitation density to avoid possible damage on the wafer or object, but this process decreases the efficiency of cleaning and decreases the usable wafer yield.

A need remains for a simple and practical method and device for controlled buffering of cavitation processes in an acoustic field, ultrasonic or megasonic, where enough cavitation density is generated to clean objects well while bubble size is controlled to avoid damage to objects.

SUMMARY OF THE INVENTION

The present invention solves these and other problems by providing a system for cleaning wafers, without substantial cavitation damage, through application of an acoustic field to a liquid, where the acoustic field is composed of multiple combined signals, including, for example, a relatively high frequency megasonic signal, a relatively lower frequency signal, and, in one embodiment, a quasi-direct voltage bias signal, such as, for example, a sawtooth waveform of relatively lower frequency compared to the other signals may be added. This results in an unbalanced combined acoustic wave applied to the object to be cleaned, such that the amplitude of the combined positive sound profile effectively buffers micro-bubble growth, while the combined negative sound profile effectively fosters micro-bubble formation. Specifically, micro-cavitation bubbles generated during the negative sound pressure cycle are impacted by larger compressive pressure during the positive sound pressure cycle, effectively buffering micro bubble growth by producing relatively quick micro size bubbles collapse with less likelihood of large bubble formation. The resulting pressure waves and shock waves from collapsing micro bubbles are smaller compared with those from ordinary sound signal summing fields without the biased voltage signal added, but provide consistent cleaning power for ensuring effective removal of particles.

In one aspect of the invention, an efficient semiconductor wafer cleaning method is provided through introduction of high frequency and low frequency sound wave components designed according to cleaning requirements, where the waves can be, for example, sinusoidal waves, step function waves, sawtooth waves, triangular waves, or the like.

In one aspect of the invention, a biased, quasi-direct voltage signal is added to the sum of a relatively high frequency signal and a relatively low frequency signal in order to create an unbalanced sound wave to clean a wafer or object in a liquid successfully with less damage to the object.

In another aspect of the invention, more micro-bubbles are created to allow cleaning an object while reducing damage from large bubbles, pressure waves, or shock waves, thus improving cleaning efficiency while simultaneously reducing damage to the object being cleaned.

In another aspect of the invention, microcavitation can be controlled in real time and on-line through a change in signal trigger times, signal amplitude, and bias.

In one aspect of the invention, a method for cleaning a fine structured object is provided, the method comprising: generating a first signal, the first signal at a first frequency; generating a second signal, the second signal having a second frequency less than the first frequency; generating a third signal, the third signal having a quasi-direct voltage with a frequency less than the second frequency; generating a combined signal, the combined signal comprising a combination of the first signal, the second signal, and the third signal; and providing the combined signal to a transducer system, the transducer system converting the combined signal to an acoustic field, said acoustic field applied to the object to be cleaned.

In one aspect of the invention, a method for cleaning an object is provided, comprising: generating a combined acoustic wave including at least a relatively high frequency component, a relatively low frequency component, and in one embodiment a bias component; and, applying the acoustic wave to a cleaning fluid to clean the object.

In another aspect of the invention, a system for cleaning a fine structured object is provided, the system comprising: a relatively high frequency function generator, the relatively high frequency function generator generating a relatively high frequency function; a relatively low frequency function generator, the relatively low frequency function generator generating a relatively low frequency function, the relatively low frequency function generator coupled to a first trigger and a first pre-amplifier; a bias function generator, the bias function generator generating a quasi-direct voltage function, the bias function generator coupled to a second trigger and a second pre-amplifier; a controller, the controller coupled to at least one of said first trigger and said second trigger, and at least one of said first preamplifier and said second preamplifier; a summing amplifier for combining the relatively high frequency function, the relatively low frequency function, and the bias function, into a combined function; and, a transducer system, the transducer system converting the combined function into an acoustic field, where the acoustic field is applied to the object to be cleaned.

DETAILED DESCRIPTION OF THE PREFERRED EMBODIMENT

Figure 1:
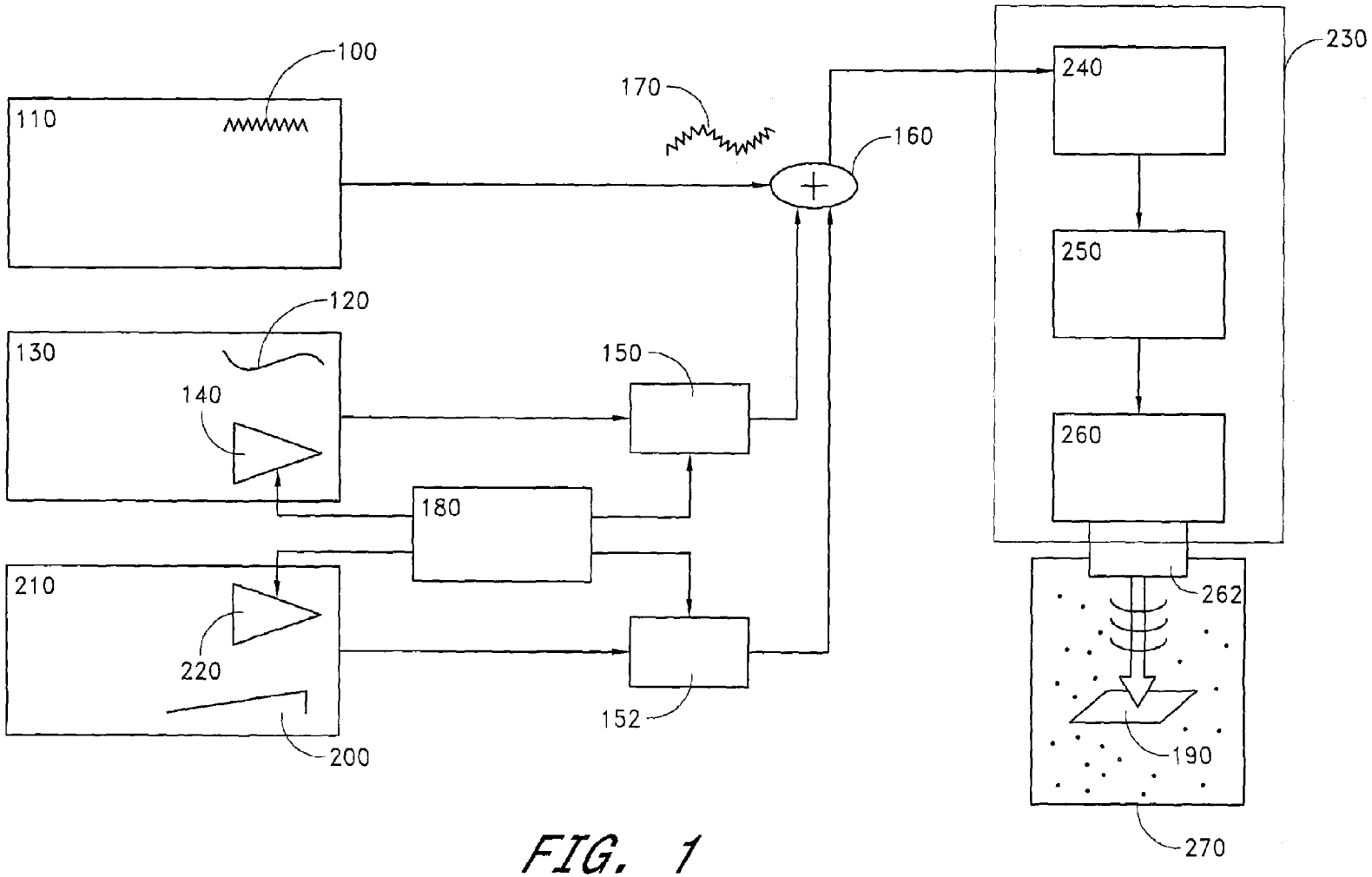
FIG. 1 is a block diagram showing one embodiment of a biased multiple frequency cleaning system of the present invention.

FIG. 1 is a block diagram showing one embodiment of a biased multiple frequency cleaning system of the present invention. A relatively high frequency signal 100 is generated by a high frequency function generator 110. A relatively low frequency signal 120 is generated by a low frequency function generator 130. Both the high frequency function generator 110 and low frequency function generator 130 advantageously generates electronic wave signals of various profiles, such as, for example, sinusoidal waves, triangular waves, sawtooth waves, step waves, and the like. The acoustic cleaning system can use any two frequency signals where the relatively low frequency signal is of a lower frequency than the relatively high frequency signal. For example, the relatively high frequency signal can be megasonic, above about 800 kHz, and the relatively low frequency signal can be ultrasonic, below about 400 kHz. Advantageously, the system can also, for example, generate two megasonic signals of relatively higher megasonic frequency and relatively lower megasonic frequency. The signals and generators can be analog or digital, and can be implemented, for example, using one or more digital signal processing (DSP) modules or using lookup tables.

The acoustic cleaning system further includes, in one embodiment, a first trigger 140 and a second trigger 220, a summing amplifier 160, a transducer system 230 including, for example, a power amplifier 240, a transformer 250, and a transducer 260, and a cleaning fluid 270 in which an object 190 to be cleaned is located. The transducer system 230 typically includes a transmitter 262 which transmits at least the longitudinal portion of the acoustic wave from the transducer 260 to the cleaning fluid 270.

The first trigger 140 controls the low frequency signal 120 so that the effective periodicity and time of output of the low frequency signal 120 from the trigger 140 can be adjusted. The low frequency signal 120 also passes through a pre-amplifier 150, from which the amplitude of the low frequency signal 120 can be adjusted in real time. The adjusted low frequency signal 120 and the high frequency signal 100 are combined in the summing amplifier 160.

The first trigger 140 and the pre-amplifier 150 are controlled by a controller 180, such as, for example, a programmable logic controller ("PLC"), software, or analog control. The controller 180 provides parameters as designated by the process operator according to the particular object 190 to be cleaned, the shape of the cleaning apparatus, type of cleaning liquid used, and so on. By way of example, a cleaning apparatus of the type described in U.S. Pat. No. 6,140,744, entitled WAFER CLEANING SYSTEM, and assigned to the assignee of the present application, and hereby incorporated by reference, can be used.

By controlling the effective time of the first trigger 140 and the gain of the pre-amplifier 150, a particular sound signal profile can be obtained by the cleaning process operator. Furthermore, the first trigger 140, the pre-amplifier 150, the summing amplifier 160, and the controller 180 can be implemented by any method that provides that the trigger exciting time of the first trigger 140, the gain of the pre-amplifier 150, and the combined signal from the summing amplifier 160 can be adjusted and controlled on-line, or preferably in real time. It is foreseen, for example, that the first trigger and first pre-amplifier may be integral parts of the function generator 130, where period and amplitude are controlled in real-time. For further example, more than one signal may be generated by a single function generator.

In order to clean an object 190 with fine structure, such as, for example, a patterned silicon wafer or small circuit component, in one embodiment a quasi-direct voltage bias signal 200 is generated from the direct voltage signal generator 210. The bias signal 200 is controlled for timing and periodicity by the second trigger 220. The bias signal 200 is then amplitude adjusted through the pre-amplifier 152. The amplitude adjusted positively biased signal 200 is then added to the relatively high frequency signal 100 and the relatively low frequency signal 120 in the summing amplifier 160, to form a combined signal 170. The bias signal is adjusted such that, once the combined signal is converted into an acoustic wave, the bias produces greater regions of positive pressure than without the bias signal added. The increased positive pressure regions further mitigate large bubble growth.

Other embodiments are foreseen where additional triggers and preamplifiers are applied to the high frequency signal 100 as well. Furthermore, multiple signals in each frequency range in one embodiment are summed to create hybrid or chaotic signals. Signal shape can be any combination of periodic or chaotic signals, where the resulting combined signal beneficially includes somewhat greater positive pressure regions than negative pressure regions over time. It is foreseen that the first signal, the second signal, and an optional third bias signal can be generated, for example, simultaneously from a lookup table or a digital signal processor: for example, an ultrasonic sine signal with a bias component can be generated from a single function generator.

The combined signal 170 continues into the transducer system 230, where the signal is, in one embodiment, adjusted through the power amplifier 240, the transformer 250, and finally to the at least one piezoelectric transducer 260. The transducer 260 emits an acoustic field into the cleaning liquid 270 through, in one embodiment, a transducing coupling layer such as a transmitter 262. The object 190 is then cleaned by the megasonic acoustic field transmitted through the cleaning liquid 270 to the object 190. More than one transducer 260 can be used, and more than one combined signal 170 can be used, to create any number of harmonic or aharmonic acoustic fields.

Figure 2:
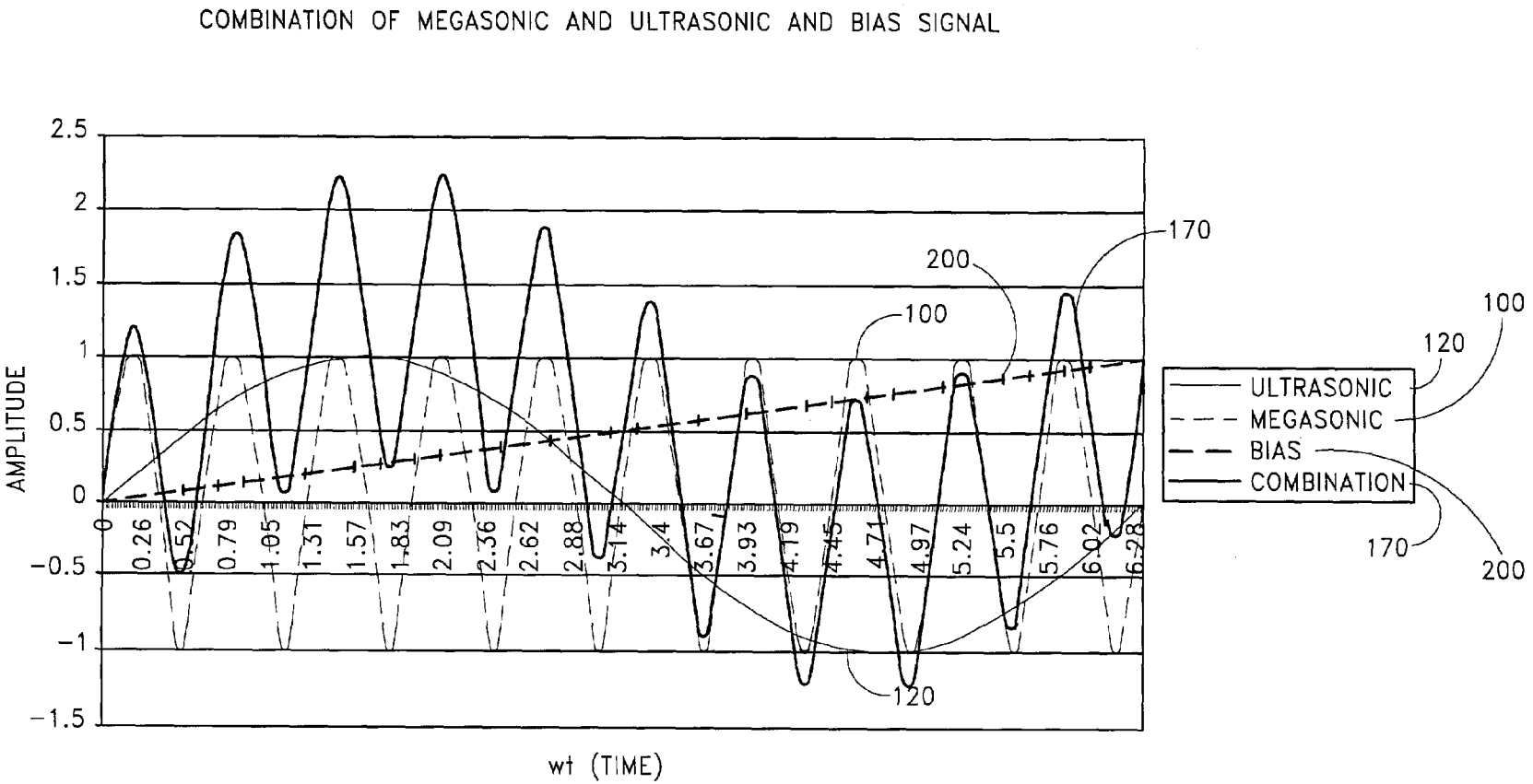
FIG. 2 illustrates a set of summed microcavitation frequencies including a high frequency megasonic signal, a sine shaped low frequency ultrasonic signal, and a sawtooth shaped biased voltage signal.

FIG. 2 illustrates a set of summed microcavitation frequencies including a high frequency signal such as, for example, a megasonic signal, and a low frequency signal, such as, for example, an ultrasonic signal, and an example step shaped bias voltage signal. It is foreseen, however, that the low frequency signal may be, for example, a megasonic signal of lower frequency. As a result, the combined signal 170 generates an combined, unbalanced sound signal profile. In FIG. 2, for example, a wave of sinusoidal form at 360 kHz is provided as a relatively low frequency signal 120. A wave of sinusoidal form at 835 kHz is provided as a relatively high frequency signal 100. A quasi-direct current bias signal 200, with a period typically greater than the high and low frequency signals, is also typically provided. The combined signal is provided to the transducer system 230, where it is translated into an acoustic wave, and where the acoustic wave is communicated to the cleaning fluid and object through a transmitter 262.

The output amplitude for positive pressure (where the acoustic signal slope is positive) is generally greater than the positive pressure of the acoustic wave created by the combined signal without the bias signal added. After small bubbles are formed during periods of negative pressure, the larger periods of positive pressure ensure that bubbles either do not grow beyond a very small size or collapse before they grow large enough to cause damage to the object to be cleaned.

Figure 3:
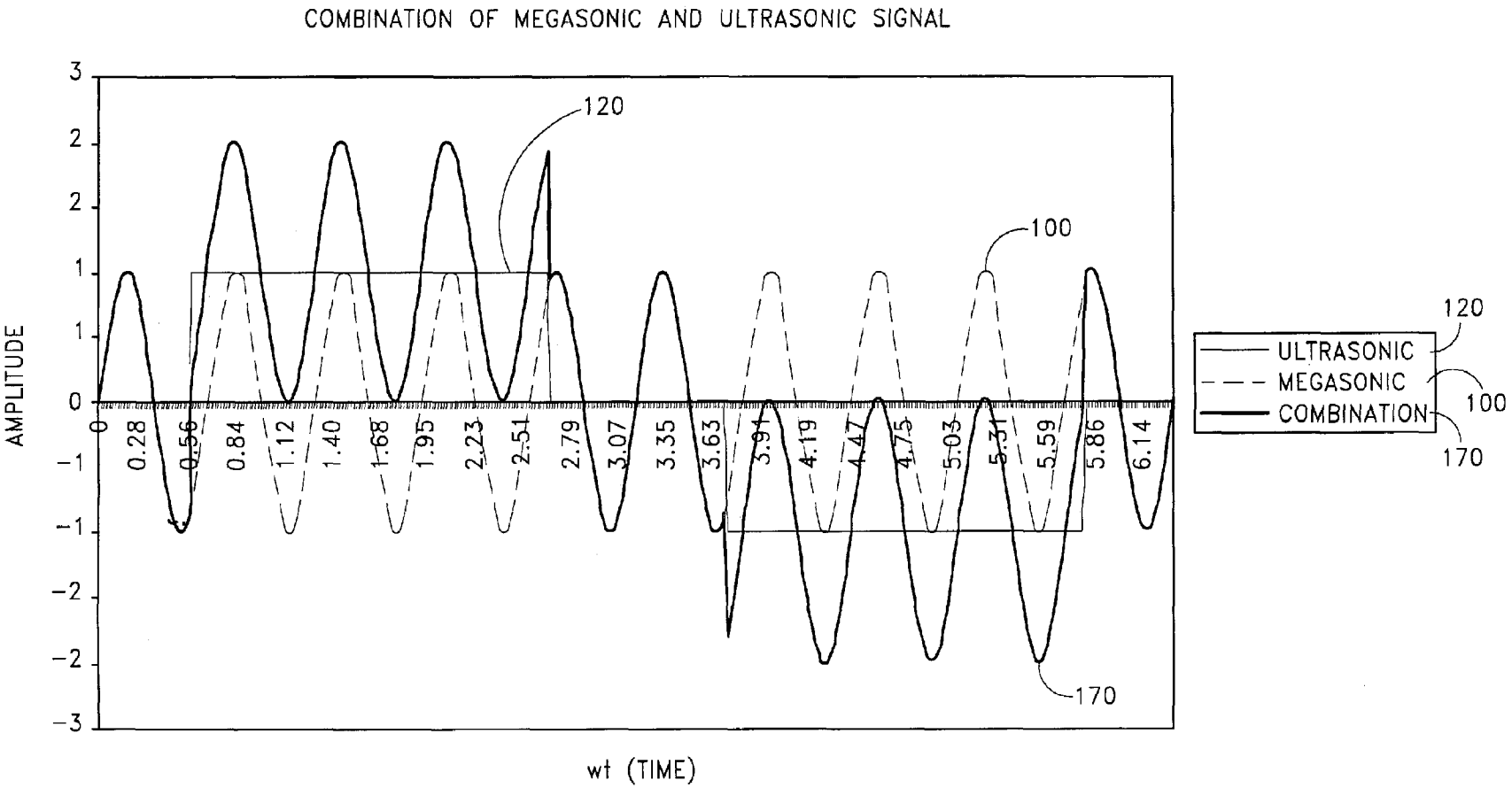
FIG. 3 illustrates another set of microcavitation frequencies provided by the system shown in FIG. 1, including a high frequency megasonic signal, and a step shaped low frequency ultrasonic signal, with the bias signal not present.

FIG. 3 illustrates another set of microcavitation frequencies provided by the system shown in FIG. 1, including a high frequency signal, such as a megasonic signal, and a step shaped low frequency signal, such as an ultrasonic signal or lower frequency megasonic signal, with the bias signal not present. In this case, a step-function wave at 360 kHz is provided as a relatively low frequency signal, and a sinusoidal wave at 835 kHz is provided as a relatively high frequency signal. This results in frequent nonlinearities in the resulting combined waveforms which assist in bubble removal in the cavitating liquid. The pressure and shock waves from collapsing bubbles are smaller than those from sound signal summing of high frequency and low frequency components without the positive bias added, reducing the risk of damage to the object. Since the amplitude of the bias can be adjusted based on the cleaning need, control of the positive bias in practice results in control of the actual size of bubbles created in microcavitation cleaning, without the simultaneous substantial loss in cleaning power. Thus, this modification effectively cleans the object by removing particles and contaminants, but also prevents fine structure damage by limiting bubble size.

Figure 4A:
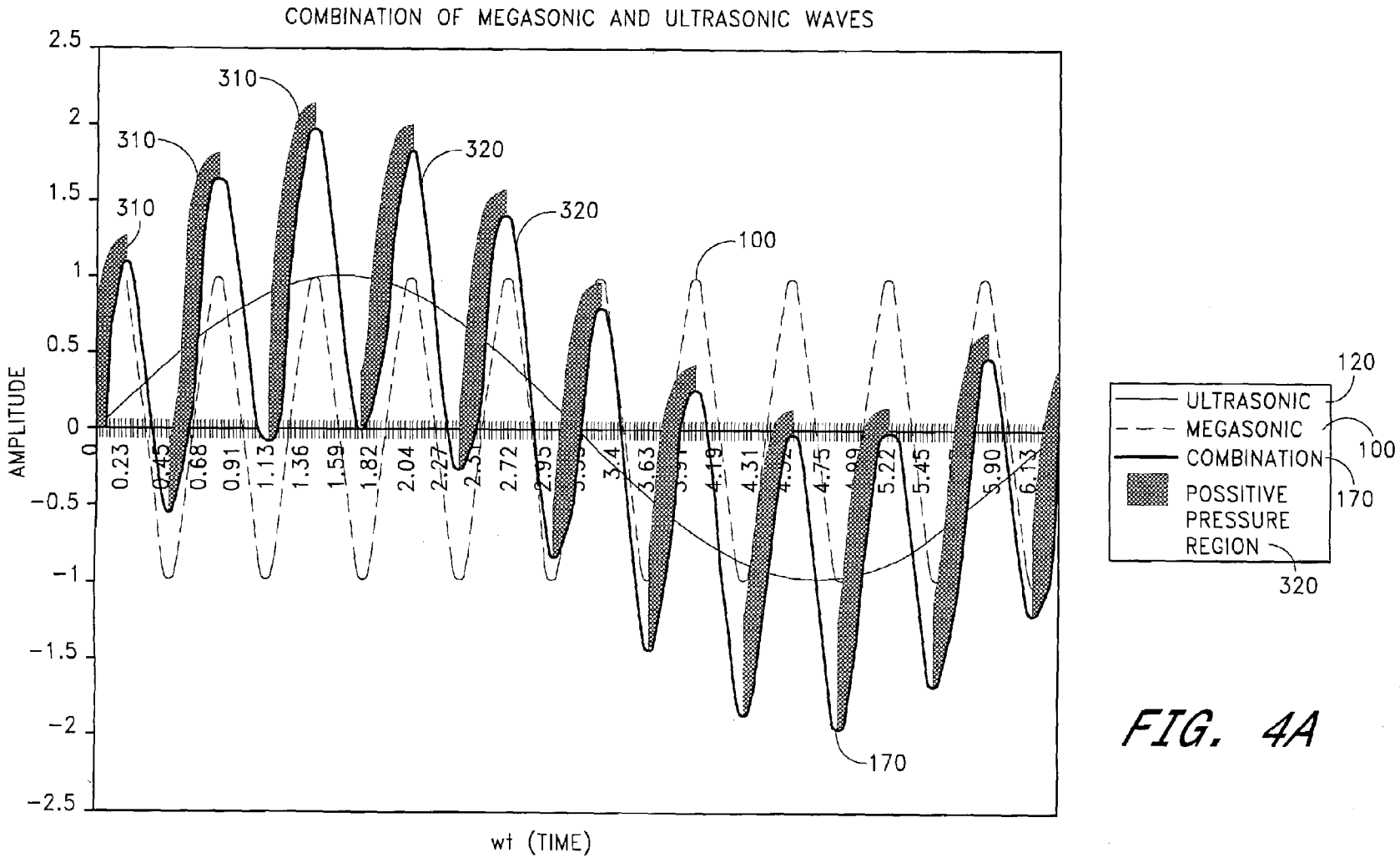
FIG. 4*a* shows a acoustic signal similar to the combined signal of FIG. 2 but without the biased voltage signal added, where the positive slope regions of the combined signal is highlighted.
Figure 4B:
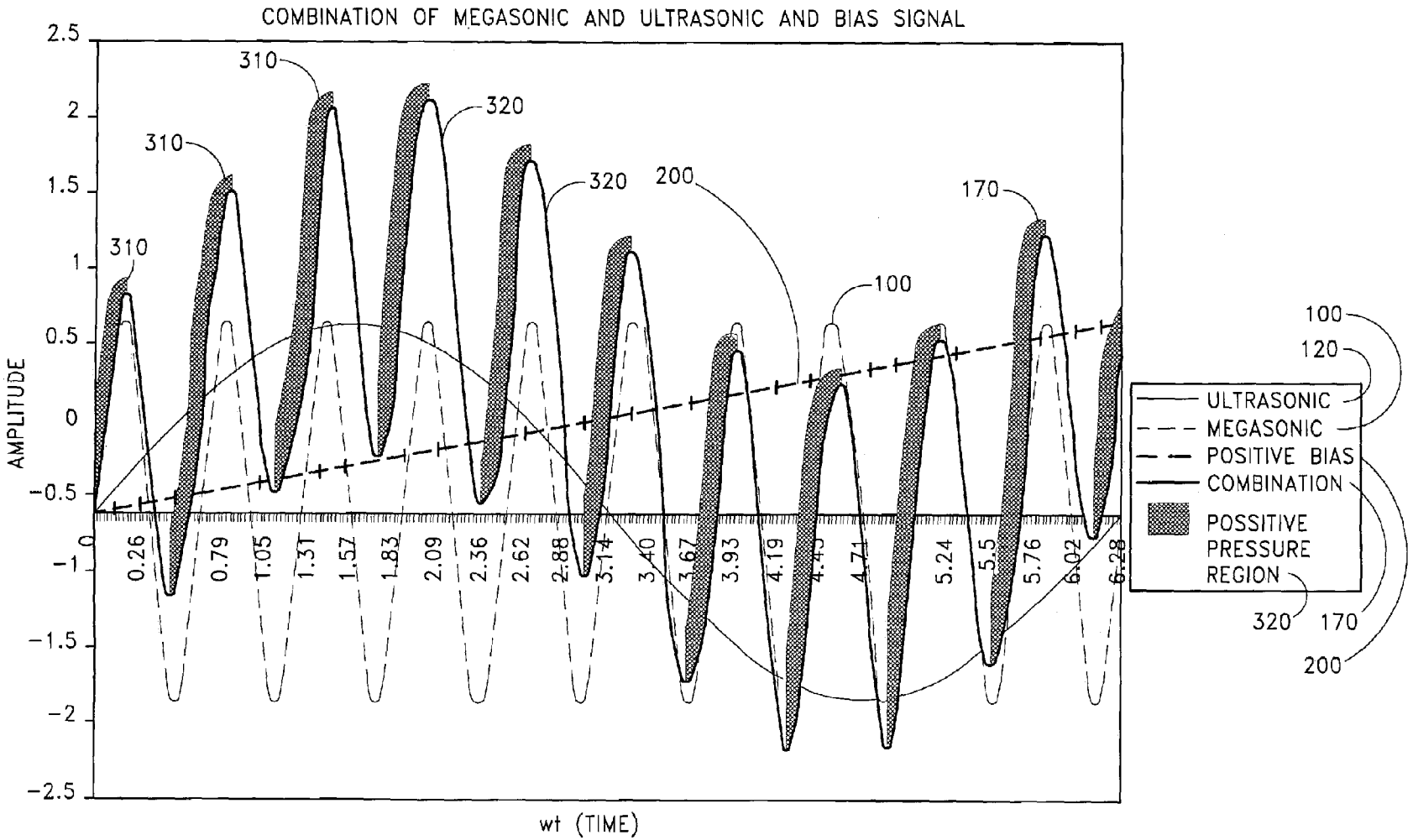
FIG. 4*b* shows, for comparison, an acoustic signal similar to the combined signal of FIG. 2 including the biased voltage signal, where the positive slope regions of the combined signal are similarly highlighted.

FIG. 4*a* shows a acoustic signal similar to the combined signal of FIG. 2 but without the biased voltage signal added. The positive slope regions of the combined signal is highlighted. FIG. 4*b* shows, for comparison, an acoustic signal similar to the combined signal of FIG. 2 including the biased voltage signal, where the positive slope regions of the combined signal are similarly highlighted. With the addition of the positively biased signal 200, the regions of positive slope 310 with the positively biased signal 200 added are typically greater than the regions of positive slope 310 without the positively biased signal. Thus, the regions of positive slope 310 are also generally larger than the regions of negative slope 320, resulting in destruction of bubbles before the bubbles can become large enough to cause substantial damage to the object to be cleaned.

Microcavitation is created by acoustic excitation of the acoustic cleaning system when the piezoelectric transducer 260 transfers the high frequency signal 100 component of the combined signal 170 into a mechanical vibration. In addition, in one embodiment, the high frequency mechanical vibration of the transducer 260 matches a phase of the low frequency signal 120, creating a combined modularized vibration which emits a sound wave towards the cleaning liquid 270. In general, the frequency response of the transducer 260 at different frequencies depends on transducer shape, structure and material. One transducer can have several resonant frequencies at which the capacitive and the inductive impedance of the transducer 260 are substantially cancelled with respect to each other, preferably when the high frequency and low frequency signals are harmonically related. Using the resonant frequencies, the transducer has high Q values that lead to high-energy output.

Therefore, in one embodiment, before determining the fundamental frequencies of the high frequency signal and low frequency signals to be used in the process, the frequency response spectrum of the transducer is typically calibrated. From the frequency response spectrum, once known, the high frequency signal and low frequency signal used in the transducer system are selected based on the high frequency response such that there is no obvious response decay if the frequency shifts by about 0.5% from the central high frequency selected. An example application is realized by modification of an existing single wafer cleaner, such as the wafer cleaning system of U.S. Pat. No. 6,140,744 to Bran, discussed previously. This system employs the combined sound energy of megasonic and ultrasonic frequencies, generated from a flat electric transducer of circular shape. A combination of higher frequency signals and lower frequency signals, such as, for example megasonic and ultrasonic signals, are mechanically expressed through the transducer, after which the resulting sound waves travel through a coupling layer between the transducer base and a quartz lens: the transmitter 262 is used to increase the efficiency of the sound transmission at the interface between different materials. It should be noted that, depending on the transducer system used, the combined signal may be inverted before it becomes an acoustic field, such that the maxima and minima of the combined signal may be reversed in the resulting acoustic wave.

The sound waves include longitudinal and transverse portions, which propagate from the transducer through the quartz lens. A certain amount of both waves in the quartz lens transmits through the interface between the lower part of the quartz lens and the liquid meniscus below the lens to form new longitudinal waves which then impinge on the wafer surface in the cleaning fluid. In the liquid layer on the wafer surface, only longitudinal sound waves energized by combined megasonic and ultrasonic frequencies propagate to generate micro bubbles which are sub micron in diameter. Since the lower frequency sound component typically changes the contour of the higher frequency wave, it extends the time interval of the negative sound pressure cycle. The bubbles are easily generated under this longer time interval of negative pressure so that a greater bubble density is obtained as compared with the higher frequency signals alone.

The higher frequency component simultaneously prevents the production of large bubbles which would harm the wafer, and the addition of a bias signal component maintains bubble production, prevents production of large bubbles, and simultaneously provides an on-line, real time adjustable means to adjust the size of bubbles to be produced and reduce potential damage to the wafer.

For post Chemical Mechanical Polishing ("CMP") processes, the deposited slurry particles on the wafer surface can have a few layers, particularly for single-step wafer polishing. The controlled and buffered cavitation process of the present invention implemented using the above-mentioned system is designed to first remove top layers of slurry from the wafer by a combined megasonic signal, ultrasonic signal, and an added bias signal, applied in a sonic field.

In this example, the sound amplitude is the sum of two frequency signals (the high frequency signal and the low frequency signal) with equivalent standard amplitudes, with the bias from a quasi-direct voltage signal added as well. The cavitation bubble density and bubble sizes in the field increase by adding the standard ultrasonic wave components. Relatively violent cavitation occurs to generate high pressure and shock waves from bubbles collapsing to remove the slurries on the top layers of the wafer present after CMP, while large bubbles and wafer damage are prevented through megasonic positive pressure waves as magnified by the adjustable bias signal.

Once the top layers of the slurry are removed, the controller for the system stops the lower frequency signal (such as, for example, an ultrasonic frequency or a megasonic signal of lower frequency than the higher frequency signal) from entering the summing amplifier so only higher frequency signals excite the transducer. Fewer cavitation bubbles are generated only using megasonic signals, such that approximately half the sound amplitude is present as in the combined signal and no significant formation of large bubbles occurs. Thus, the slurry can be successfully removed from the wafer while protecting the wafer from substantial damage.

In one particular example, SS-25 slurry dipped TEOS (tetra-ethyl-ortho-silicate) wafers were cleaned using the present invention. Using only a megasonic frequency of 835 kHz at a power amplifier output of 120 Watts in a 37 second, DI water, the example system process at 60° C. had relatively poor results. Using a mixture of 835 kHz and 360 kHz sinusoid signals at the same operating conditions mentioned above, where the input signal of 360 kHz for the summing amplifier was 110 mV, showed improved results. Due to the gain limit of the power amplifier at different frequencies and the transducer frequency response for the 360 kHz signal, the result had some improvement compared with the result using only the 835 kHz frequency.

Non-consistent gain and frequency response in the power amplifier and the transducer can be improved by selecting a power amplifier with a larger bandwidth and further modifying the transducer configuration. In particular, if the lower frequency signal is shaped as a step rather than a sinusoid, and the bias signal is added to the combination of the lower frequency signal and higher frequency signal, the wafer can be cleaned to a significantly greater degree without damage.

For patterned wafers that have fine structures, such as gate stacks, bit lines, and the like, the buffered cavitation control technique shows an improvement for obtaining cleaning results without damage caused by acoustic cavitation. Table 1 lists a damage comparison between a standard megasonic cleaning and a buffered cavitation control cleaning under static status inspected by a KLA® scanner for patterned wafers that have 0.15 micron size gate stack lines. The gate stack lines have an aspect ratio of about 3:1 for the height to the width. Wafer #2 was cleaning by the buffered cavitation control method described above.

TABLE 1

Example of the damage comparison between a standard megasonic cleaning and a buffered cavitation control method

| Wafer | Transducer rod | Frequency | Pre-loading | Power | Relative Damage |
|---|---|---|---|---|---|
| 1 | Standard | 826 KHz | Yes | 50 W | 10 |
| 2 | Standard | 826/100 KHz | Yes | 50 W | 0 |

As noted above, the arrangement of FIG. 1 and the example waveform of FIG. 3 are examples of desirable embodiments from the standpoint that microcavitation can be efficiently employed with sufficient energy to clean objects while not damaging those objects. It should be recognized that other circuit arrangements, analog, optical or digital, may be employed, and various combinations of waveforms may be employed. It should also be recognized that various other modifications of similar type may be made to the embodiments illustrated without departing from the scope of the invention, and all such changes are intended to fall within the scope of the invention, as defined by the appended claims.

What is claimed is:

1. A method for cleaning a fine-structured object, the method comprising:

generating a first signal, the first signal at a first frequency;

generating a second signal, the second signal having a second frequency less than the first frequency;

generating a third signal, the third signal having a quasi-direct voltage bias and a third frequency less than the second frequency;

generating a combined signal, the combined signal comprising a combination of the first signal, the second signal, and the third signal; and providing the combined signal to a transducer system, the transducer system converting the combined signal to an acoustic field, said acoustic field applied to die object to be cleaned.

2. The method of claim 1, wherein the method further includes:

adjusting the timing of the second frequency signal through a first trigger;

adjusting the amplitude of the second frequency signal through a first preamplifier; and buffering micro bubble growth while increasing micro bubble formation through at least one of the adjustment of the first trigger and adjustment of the first preamplifier.

3. The method of claim 2, where the buffering is accomplished in real-time.

4. The method of claim 1, wherein the method further includes:

adjusting the timing of the third frequency signal through a second trigger;

adjusting the amplitude of the third frequency signal through a second preamplifier; and buffering micro bubble growth while increasing micro bubble formation through at least one of the adjustment of the second trigger and adjustment of the second preamplifier.

5. The method of claim 4, where the buffering is accomplished in real-time.

6. The method of claim 1, wherein the method further includes:

generating the second signal to be a step wave.

7. The method of claim 1, wherein the method further includes:

adjusting a bias of the third signal to increase the regions of positive pressure relative to the regions of negative pressure in the acoustic field applied to the object to be cleaned.

8. The method of claim 1, wherein the method further includes:

controlling the timing and amplitude of the second signal in real time.

9. The method of claim 1, wherein the method further includes:

controlling the timing and amplitude of the third signal in real time.

10. A method for cleaning an object comprising combining a first higher frequency megasonic signal and a second lower frequency megasonic signal into a combined signal;

applying the combined signal to a transducer system, the transducer system converting the combined signal into acoustic waves;

creating microcavitation through regions of negative pressure in the acoustic waves;

buffering microcavitation through regions of positive pressure in the acoustic waves;

applying the acoustic wave to the object to be cleaned in a cleaning fluid; and adding a quasi-direct voltage bias signal having a frequency less than the frequency of the second megasonic signal to the combined signal.

11. The method of claim 10 further comprising adjusting at least one of a period and an amplitude of the combined signal to buffer micro-bubble growth.

12. The method of claim 10, further comprising adjusting at least one of a period and an amplitude of the bias signal to buffer micro-bubble growth.

* * * * *